US008146962B2

(12) United States Patent
Lu et al.

(10) Patent No.: US 8,146,962 B2
(45) Date of Patent: Apr. 3, 2012

(54) LATCH STRUCTURE OF FIRE DOOR LOCK

(75) Inventors: Shih-Min Lu, Ziguan Township, Kaohsiung County (TW); Fu-Chih Huang, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 0 days.

(21) Appl. No.: 13/094,018

(22) Filed: Apr. 26, 2011

(65) Prior Publication Data

US 2011/0198871 A1 Aug. 18, 2011

Related U.S. Application Data

(63) Continuation-in-part of application No. 12/216,644, filed on Jul. 9, 2008.

(51) Int. Cl.
*E05B 65/10* (2006.01)

(52) U.S. Cl. ..... 292/93; 292/DIG. 65

(58) Field of Classification Search ..... 292/220, 292/92, 93, DIG. 41, DIG. 65; 70/92
See application file for complete search history.

(56) References Cited

U.S. PATENT DOCUMENTS

| | | | | |
|---|---|---|---|---|
| 2,762,642 | A * | 9/1956 | Jewett | 292/92 |
| 4,875,722 | A * | 10/1989 | Miller et al. | 292/92 |
| 5,464,259 | A * | 11/1995 | Cohrs et al. | 292/92 |
| 6,009,732 | A * | 1/2000 | Haeck et al. | 70/92 |
| 7,070,210 | B2 * | 7/2006 | Lin | 292/93 |

FOREIGN PATENT DOCUMENTS

TW 568160 A1 12/2003

* cited by examiner

*Primary Examiner* — Gary Estremsky
(74) *Attorney, Agent, or Firm* — Jackson IPG PLLC; Demian K. Jackson

(57) ABSTRACT

A latch structure of fire door lock includes a lock base, a latch unit, a blocking member, an elastic member and a linking set. The lock base comprises an accommodating slot, a first lateral portion having a first sliding slot, and a second lateral portion having a second sliding slot. The latch unit has a combining pin. The blocking member is disposed in the accommodating slot and includes a contacting portion. The contacting portion is pressed by the elastic member. The combining pin is connected at the linking set and the latch unit. Two end portions of the combining pin are slidably disposed at the first sliding slot and the second sliding slot respectively. The end portions of the combining pin are restrained within a first recess of the first sliding slot and a second recess of the second sliding slot respectively.

13 Claims, 12 Drawing Sheets

LATCH STRUCTURE OF FIRE DOOR LOCK

CROSS REFERENCE TO RELATED APPLICATIONS

This application is a Continuation-in-Part of co-pending application Ser. No. 12/216,644 filed on Jul. 9, 2008, and for which priority is claimed under 35 U.S.C. §120, the entire contents of which are hereby incorporated by reference.

FIELD OF THE INVENTION

The present invention is generally relating to a latch structure of fire door lock, more particularly to the latch structure of fire door lock with fireproof and burglarproof functions.

BACKGROUND OF THE INVENTION

Taiwan patent publication No. 568160 disclosed "structure of fireproof doors" is relevant to a fire door lock. Two latch bolts are disposed at an upper end and a lower end of a fire door separately, and the latch bolts can be blocked by two stoppers disposed at a door frame therefore forming a lock state. Usually, the blocked latch bolts departs from the stoppers and leads to an unlock state via actuation of a main lock. With reference to FIG. 1, a fire door lock comprises a latch structure 20 disposed at a fire door 10 and a stopper 40 disposed at a door frame 40. The latch structure 20 comprises at least a lock base 21 and a latch tongue 22 having a blocking surface 23 and a restraining surface 24 opposite to the blocking surface 23. The latch tongue 22 is swingably disposed at the lock base 21. Once the latch structure 20 and the stopper 40 are situated in a lock state, the blocking surface 23 of the latch bolt 22 may contact against the stopper 40 to prevent the fire door 10 from being opened. Once the latch structure 20 and the stopper 40 are situated in an unlock state, the latch bolt 22 is actuated by a main lock (not shown in Figs.) to shrink into the lock base 21. At this time, the latch bolt 22 is not blocked by the stopper 40 to enable the fire door 10 to be opened. With reference to FIG. 2, when the state of the fire door 10 is switched from the unlock state to the lock state, the latch tongue 22 can not be actuated by the main lock to enable the latch tongue 22 to still protrude from the lock base 21. In this moment, the latch bolt 22 must pass through the stopper 40 to form a lock state. Generally, the fire door 10 is actuated by a door closer (not shown in Figs.), once the thrust of the door closer for driving the fire door 10 is insufficient, the stopper 40 contacts against the restraining surface 24, and eventually an unlock situation is formed between the latch structure 20 and the stopper 40. Therefore, the fireproof and burglarproof functions of the fire door 10 will be all lost via incapability of closing the fire door 10.

Besides, referring to FIG. 1, by using appropriate tools, the latch bolt 22 of the latch structure 20 can be easily pushed and shrunk into the lock base 21 by a thief to form an unlock state between the latch structure 20 and the stopper 40. Therefore, the burglarproof function will be lost.

SUMMARY

The primary object of the present invention is to provide a latch structure of fire door lock comprising a lock base, a latch unit, a blocking member, an elastic member, a linking set and a fixing rod. The lock base comprises a bottom portion, a first lateral portion, a second lateral portion and an accommodating slot defined by the bottom portion, the first lateral portion and the second lateral portion. The first lateral portion comprises a first sliding slot, and the second lateral portion comprises a second sliding slot. The latch unit comprises a latch bolt and a combining pin, the latch unit is swingably disposed at the accommodating slot of the lock base, and the latch bolt can be driven by the combining pin to enable the latch bolt to retractably protrude from the lock base. The blocking member is swingably disposed at the accommodating slot of the lock base. The liking set is disposed at the accommodating slot and comprises at least one first linking member, and the combining pin is pivotally connected with the first linking member and the latch unit. The combining pin comprises a first end portion and a second end portion, the first end portion and the second end portion are slidably disposed at the first sliding slot and the second sliding slot respectively, the first end portion can be restrained within a first recess of the first sliding slot, and the second end portion can be restrained within a second recess of the second sliding slot. The fixing rod is pivotally connected with the blocking member and the first linking member of the linking set. The fixing rod comprises a first fixing end and a second fixing end, and the first fixing end and the second fixing end are fixed at the first lateral portion and the second lateral portion respectively.

Via the limitation of the first end portion located within the first recess and the limitation of the second end portion located within the second recess, when a thief tends to push the latch bolt into the lock base by using tools, the latch bolt can not shrink into the latch base by means of position limitation of the first end portion and the second end portion of the combining pin. Therefore, the burglarproof function can be effectively achieved in this invention.

The secondary object of this invention is to provide a latch structure of fire door lock, wherein the blocking member comprises a blocking plate, a contacting portion and a restraining slot positioned beneath the blocking plate. The elastic member comprises a first end, and the contacting portion of the blocking member can be pressed by the first end. The restraining slot is corresponded to the latch bolt. Once the fire door is situated in an unlock state, the latch bolt can be shrunk into the lock base to enable the blocking member to swing toward the latch bolt via elasticity of the elastic member, and the latch bolt is accommodated into the restraining slot of the blocking member. At last, the blocking plate of the blocking member contacts against a restraining surface of the latch bolt. When the state of the fire door is switched from an unlock state into the lock state, the latch bolt may pass through a stopper disposed at a door frame rather than being blocked by the stopper. Eventually, the blocking member may prop against the stopper to enable the latch bolt to depart from the restraining slot of the blocking member and protrude from the lock base to from a lock state.

DETAILED DESCRIPTION OF THE INVENTION

Figure 1:
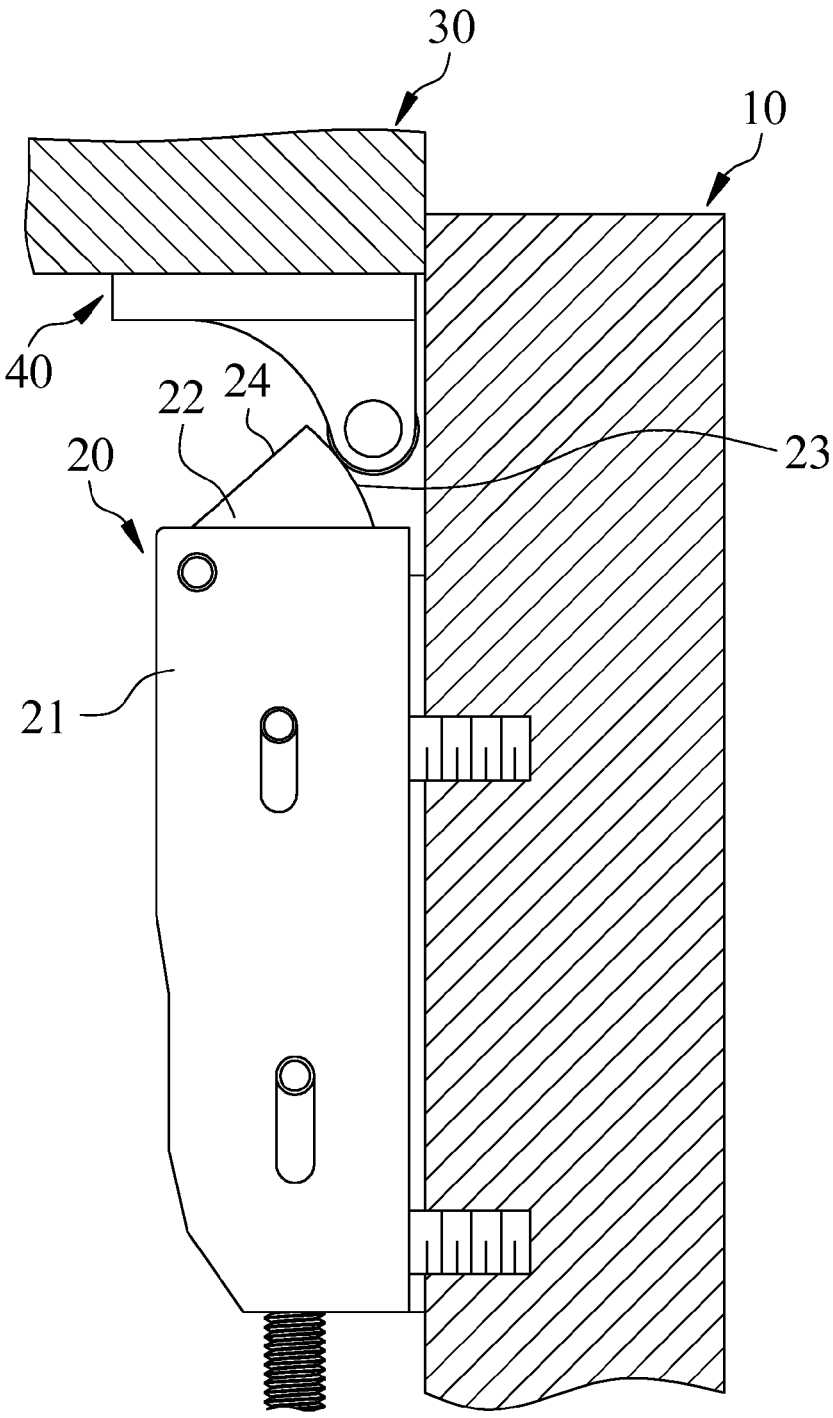
FIG. 1 PRIOR ART
FIG. 1 is a schematic diagram illustrating a lock state formed between a latch bolt of a conventional fire door lock and a stopper.
Figure 2:
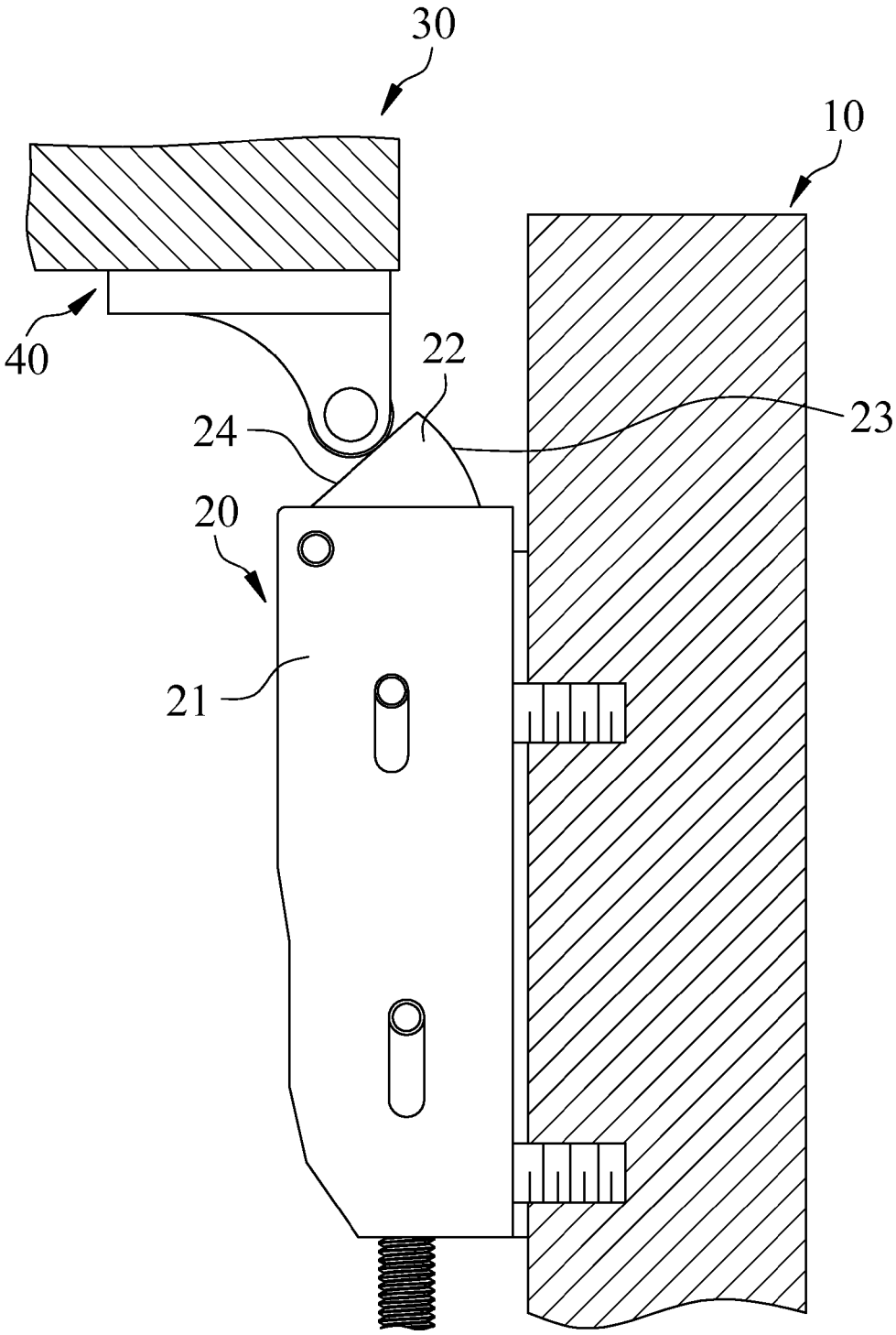
FIG. 2 PRIOR ART
FIG. 2 is a schematic diagram illustrating an unlock situation formed between the latch bolt of the conventional fire door lock and the stopper.
Figure 3:
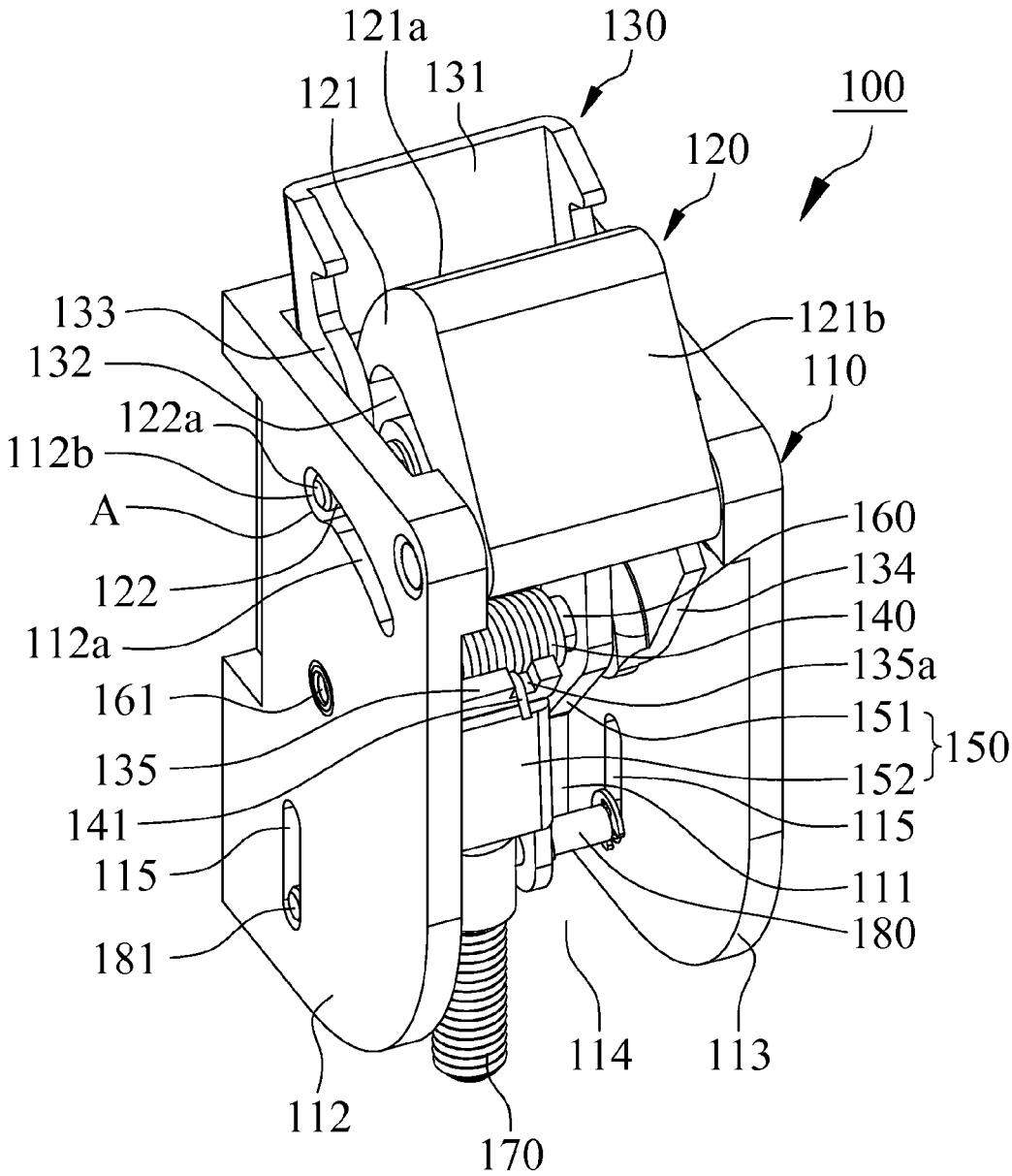
FIG. 3 is a perspective assembly view illustrating a latch structure of fire door lock in accordance with a preferred embodiment of the present invention.
Figure 4:
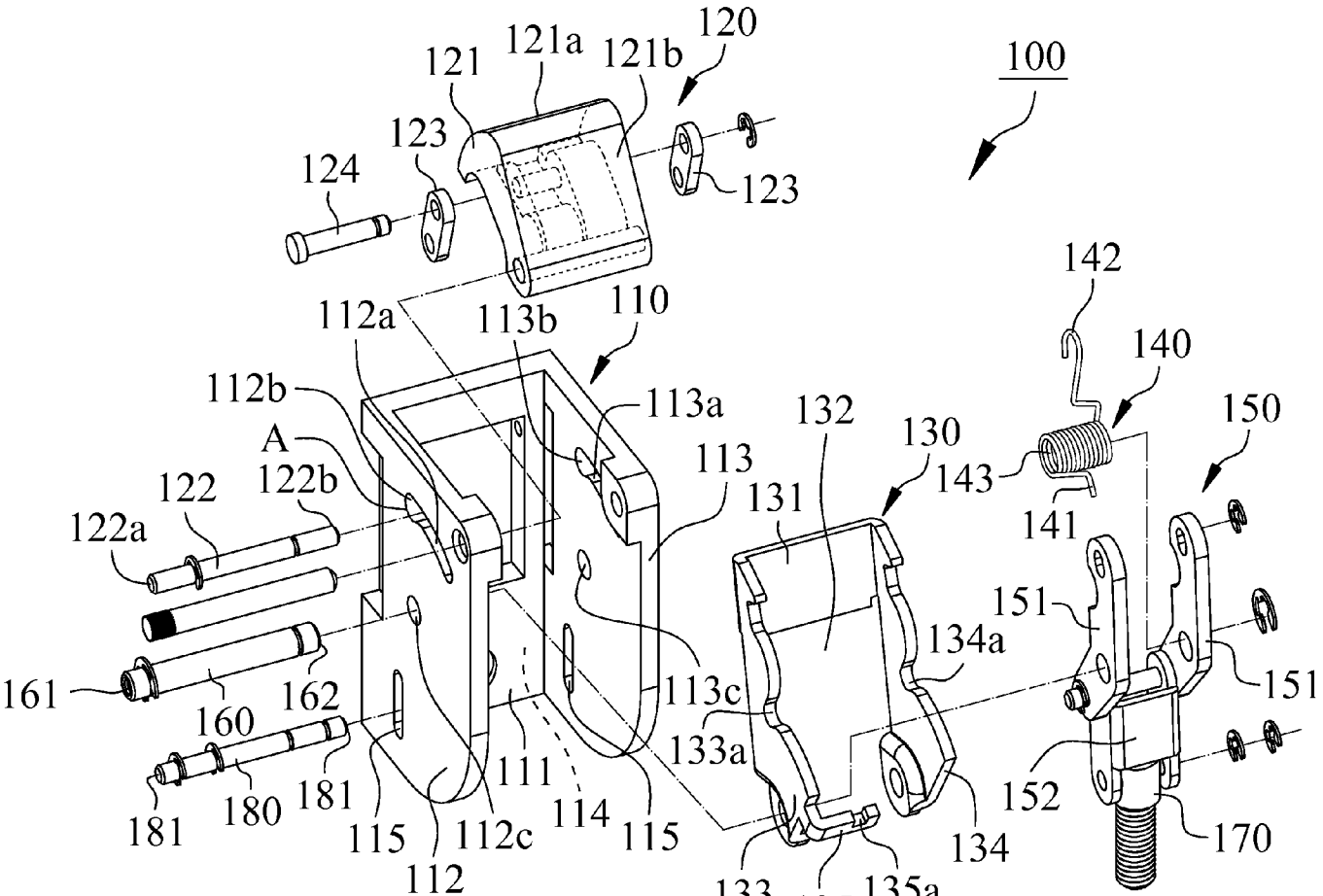
FIG. 4 is a perspective exploded view illustrating the latch structure of fire door lock in accordance with a preferred embodiment of the present invention.
Figure 5:
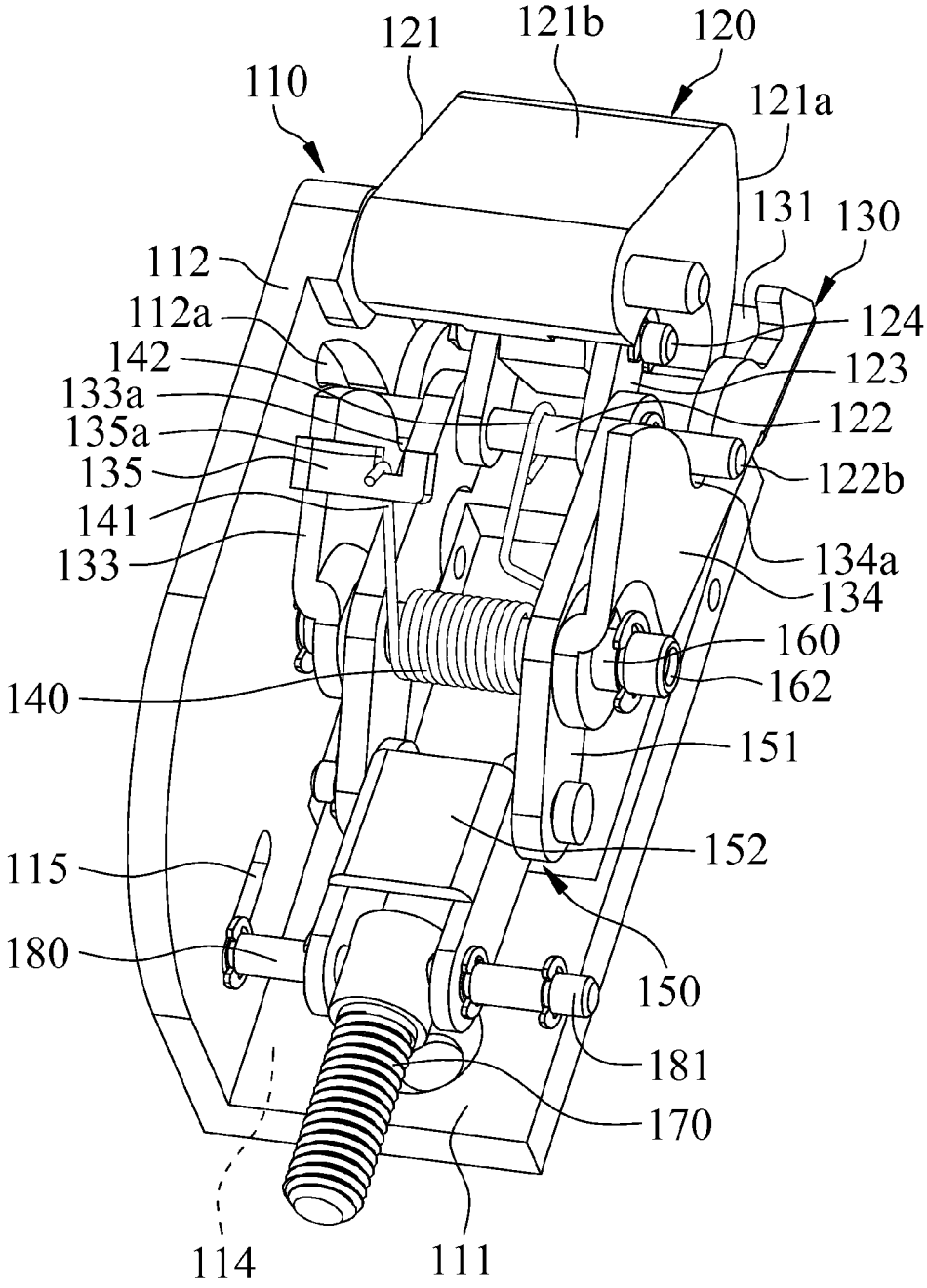
FIG. 5 is an upward view illustrating the latch structure of fire door lock in accordance with a preferred embodiment of the present invention.

With reference to FIGS. 3, 4 and 5, a latch structure of fire door lock 100 in accordance with a preferred embodiment of the present invention comprises a lock base 110, a latch unit 120, a blocking member 130, an elastic member 140, a linking set 150 and a fixing rod 160. The lock base 110 comprises a bottom portion 111, a first lateral portion 112, a second lateral portion 113 and an accommodating slot 114 defined by the bottom portion 111, the first lateral portion 112 and the second lateral portion 113. The first lateral portion 112 comprises a first sliding slot 112*a* and a first installing hole 112*c*, the second lateral portion 113 comprises a second sliding slot 113*a* and a second installing hole 113*c*, the fixing rod 160 comprises a first fixing end 161 and a second fixing end 162, and the first fixing end 161 and the second fixing end 162 of the fixing rod 160 can be inserted into the first installing hole 112*c* and the second installing hole 113*c* respectively. The first sliding slot 112*a* and the second sliding slot 113*a* are formed into a concave arc A, wherein each of the concave arcs A is oriented to the first installing hole 112*c* and the second installing hole 113*c* separately. The first sliding slot 112*a* comprises a first recess 112*b*, the second sliding slot 113*a* comprises a second recess 113*b*, and the first recess 112*b* and the second recess 113*b* are adjacent to the bottom portion 111 of the lock base 110.

The latch unit 120 comprises a latch bolt 121, a combining pin 122, at least one actuating member 123 and a penetrating bolt 124. In this embodiment, the quantity of mentioned actuating member 123 is two, and the penetrating bolt 124 is penetrated through the actuating members 123 and the latch bolt 121 to form a mutual link between the actuating members 123 and the latch bolt 121. The latch 121 comprises a blocking surface 121*a* and a restraining surface 121*b* in communication with the blocking surface 121*a*. The combining pin 122 comprises a first end portion 122*a* and a second end portion 122*b*, and the first end portion 122*a* and the second end portion 122*b* are slidably disposed at the first sliding slot 112*a* and the second sliding slot 113*a* respectively. The latch bolt 121 is swingably disposed at the accommodating slot 114 of the lock base 110. The latch bolt 121 can be driven by the combining pin 122 between a projected position and a retracted position in response to the movement of the actuating member 123. When the fire door 200 is situated in a lock state, the latch bolt 121 is located at the projected position (please see FIGS. 6 and 9). Oppositely, when the fire door 200 is situated in an unlock state, the latch bolt 121 is located at the retracted position (please see FIG. 10). The blocking member 130 is swingably disposed at the accommodating slot 114 of the lock base 110 and comprises a blocking plate 131, a restraining slot 132 located beneath the blocking plate 131, a first lateral plate 133 protruded from the blocking plate 131 and a second lateral plate 134 opposite to the first lateral plate 133. The first lateral plate 133 comprises a first restraining recess 133*a*, the second lateral plate 134 comprises a second restraining recess 134*a*, and the combining pin 122 can be restrained within the first restraining recess 133*a* and the second restraining recess 134*a*.

In this embodiment, the length of the blocking plate 131 is smaller than that of the first and the second lateral plates 133, 134 to lead an incomplete connection between the blocking plate 131, the first lateral plate 133 and the second lateral plate 134 therefore forming the restraining slot 132. The restraining slot 132 is corresponded to the latch bolt 121. The latch bolt 121 may be blocked by the blocking plate 131 of the blocking member 130 and accommodated into the restraining slot 132. The blocking member 130 can be actuated by elasticity of the elastic member 140 disposed at the accommodating slot 114 of the lock base 110.

In this embodiment, the elastic member 140 can be a torsion spring, the torsion spring comprises a first end 141, a second end 142 and a barrel portion 143 disposed around the fixing rod 160. The blocking member 130 further comprises a contacting portion 135 which is pressed by the first end 141 of the elastic member to enable the blocking member 130 to swing toward the latch bolt 121. Besides, the contacting portion 135 can be a cantilever protruded from the first lateral plate 133 and faces toward the second lateral plate 134. In this embodiment, the contacting portion 135 comprises a trench 135*a*, the first end 141 of the elastic member 140 is coupled to the trench 135*a*, and the second end 142 of the elastic member 140 is coupled to the combining pin 122 of the latch unit 120.

The linking set 150 is disposed at the accommodating slot 114 and comprises at least one first linking member 151. The combining pin 122 is pivotally connected with the first linking member 151 and the latch unit 120. In this embodiment, the quantity of mentioned first linking member 151 is two, the actuating members 123 are located between the first linking members 151, and the first linking members 151 are located between the first and the second lateral plates 133, 134. The combining pin 122 is penetrated through the actuating members 123 and the first linking members 151 to form a mutual link between the actuating members 123 and the first linking members 151.

When the latch bolt 121 extends outwardly from the lock base 110, the first end portion 122*a* of the combining pin 122 can be restrained within the first recess 112*b* of the first sliding slot 112*a*, and the second end portion 122*b* can be restrained within the second recess 113*b* of the second sliding slot 113*a*. Therefore, the combining pin 122 can be effectively restrained within mentioned sliding slots to prevent from separation with the lock base 110. Meanwhile, the first end portion 122*a* of the combining pin 122 can be restrained within the first restraining recess 133*a* of the first lateral plate 133 and the second end portion 122*b* can be restrained within the second restraining recess 134*a* of the second lateral plate 134 to prevent the latch bolt 121 from being pushed into the lock base 110 by external force to lead an unlock situation.

The fixing rod 160 is pivotally connected with the blocking member 130 and the first linking members 151 of the linking set 150, and the first and the second lateral plates 133, 134 of the blocking member 130 are located between the first linking members 151. The first fixing end 161 and the second fixing end 162 are fixed at the first lateral portion 112 and the second lateral portion 113 of the lock base 110 respectively. The fixing rod 160 is penetrated through the first lateral plate 133, the first linking members 151 and the second lateral plate 134 to form a mutual linked relationship between the first lateral plate 133, the first linking members 151 and the second lateral plate 134. In this embodiment, the latch structure of fire door lock 100 further comprises a linking rod 170, and one end of the linking rod 170 is pivotally connected with the linking set 150.

With reference to FIGS. 3, 4 and 5 again, the latch structure of fire door lock 100 further comprises a pivoting rod 180, and the linking set 150 further comprises a second linking member 152. The first linking member 151 is pivotally connected with the second linking member 152, and the pivoting rod 180 is pivotally connected with the second linking member 152 and the linking rod 170. Besides, the first lateral portion 112 and the second lateral portion 113 of the lock base 110 comprise a longitudinal sliding slot 115 respectively. The pivoting rod 180 comprises two terminals 181, and each of the terminals 181 can be slidably disposed at each of the longitudinal sliding slots 115.

Figure 6:
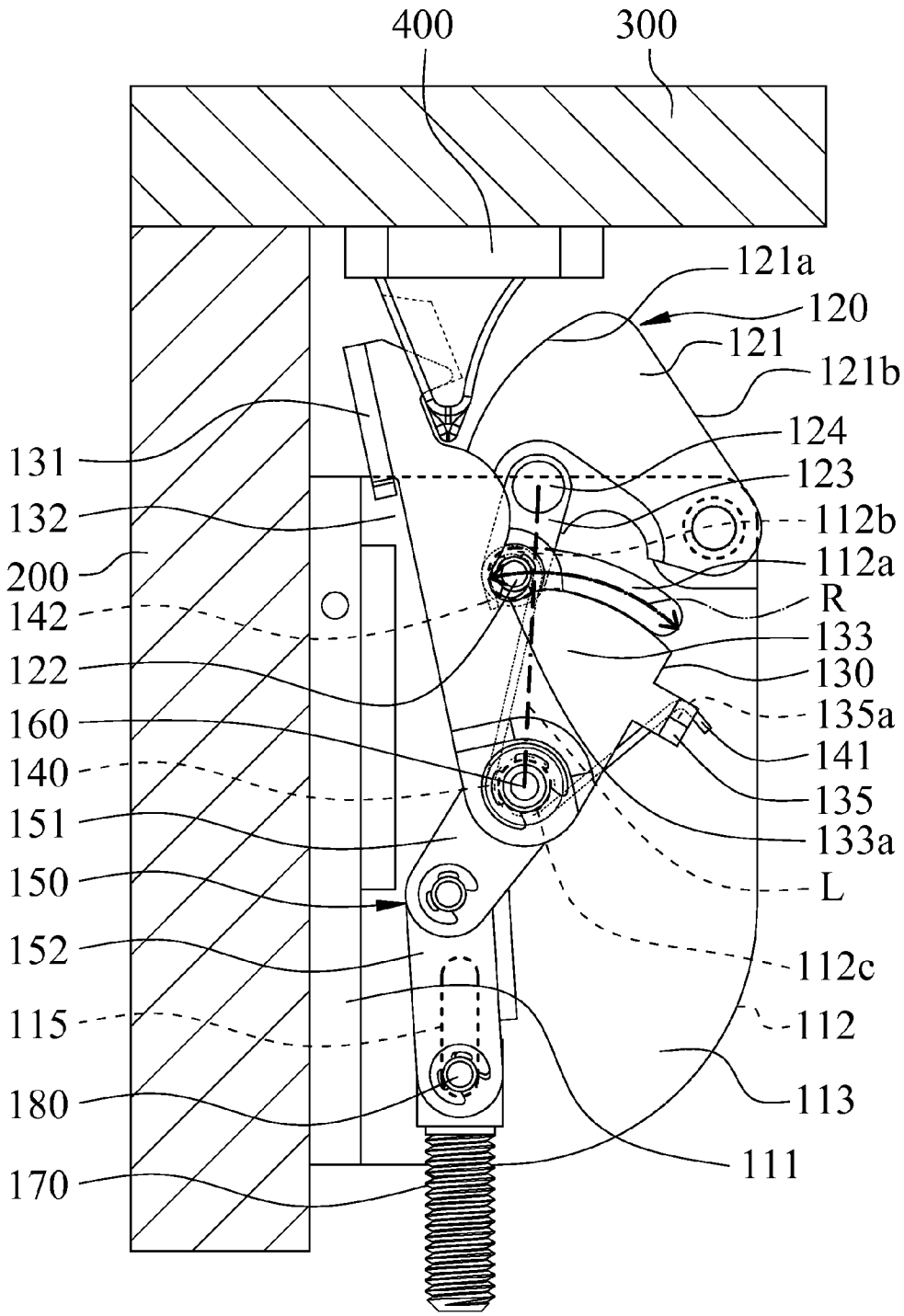
FIG. 6 is a schematic diagram illustrating a lock state formed between the latch structure of fire door lock and the stopper in accordance with a preferred embodiment of the present invention.
Figure 7:
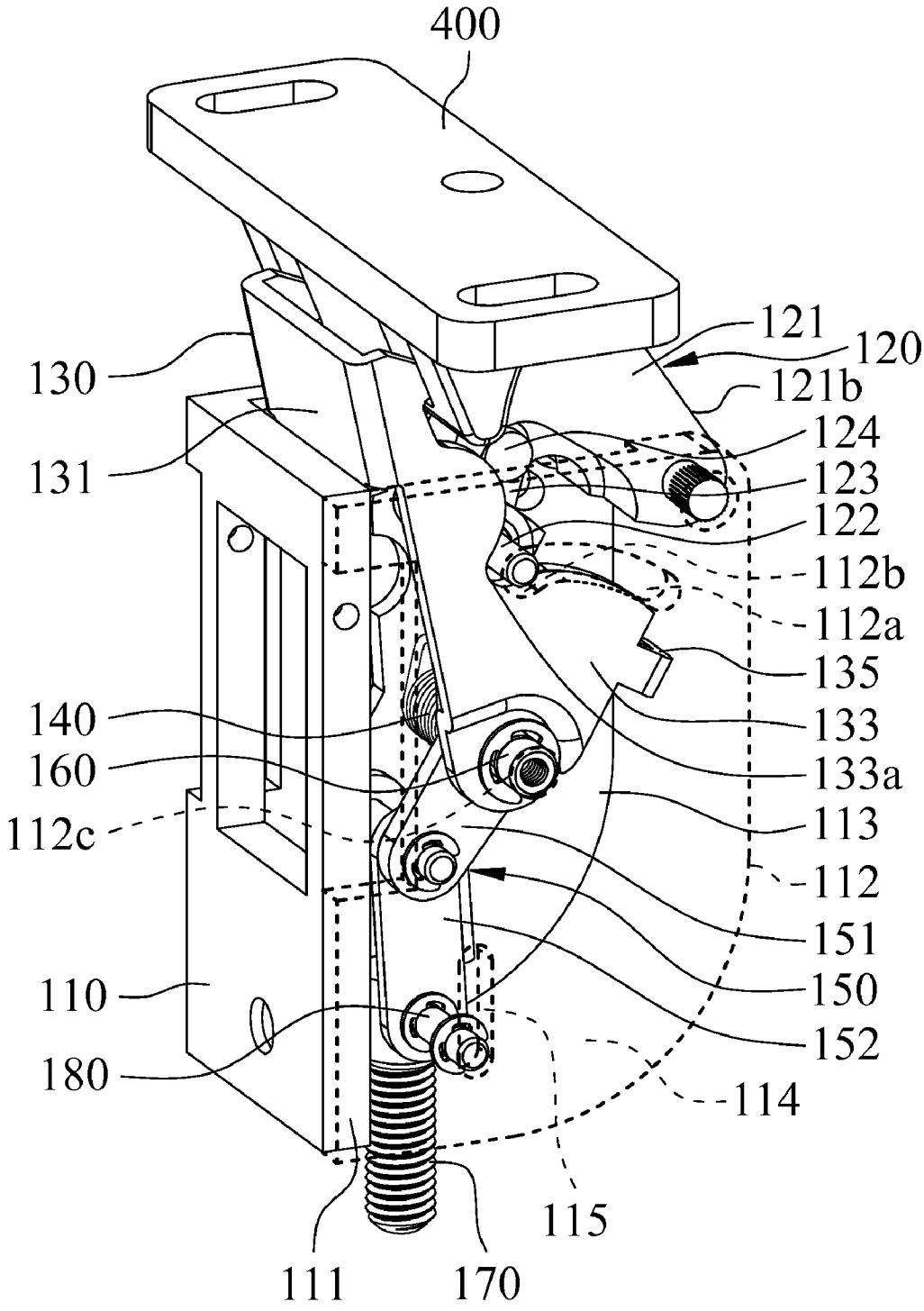
FIG. 7 is a perspective schematic diagram illustrating a lock state formed between the latch structure of fire door lock and the stopper in accordance with a preferred embodiment of the present invention.
Figure 8:
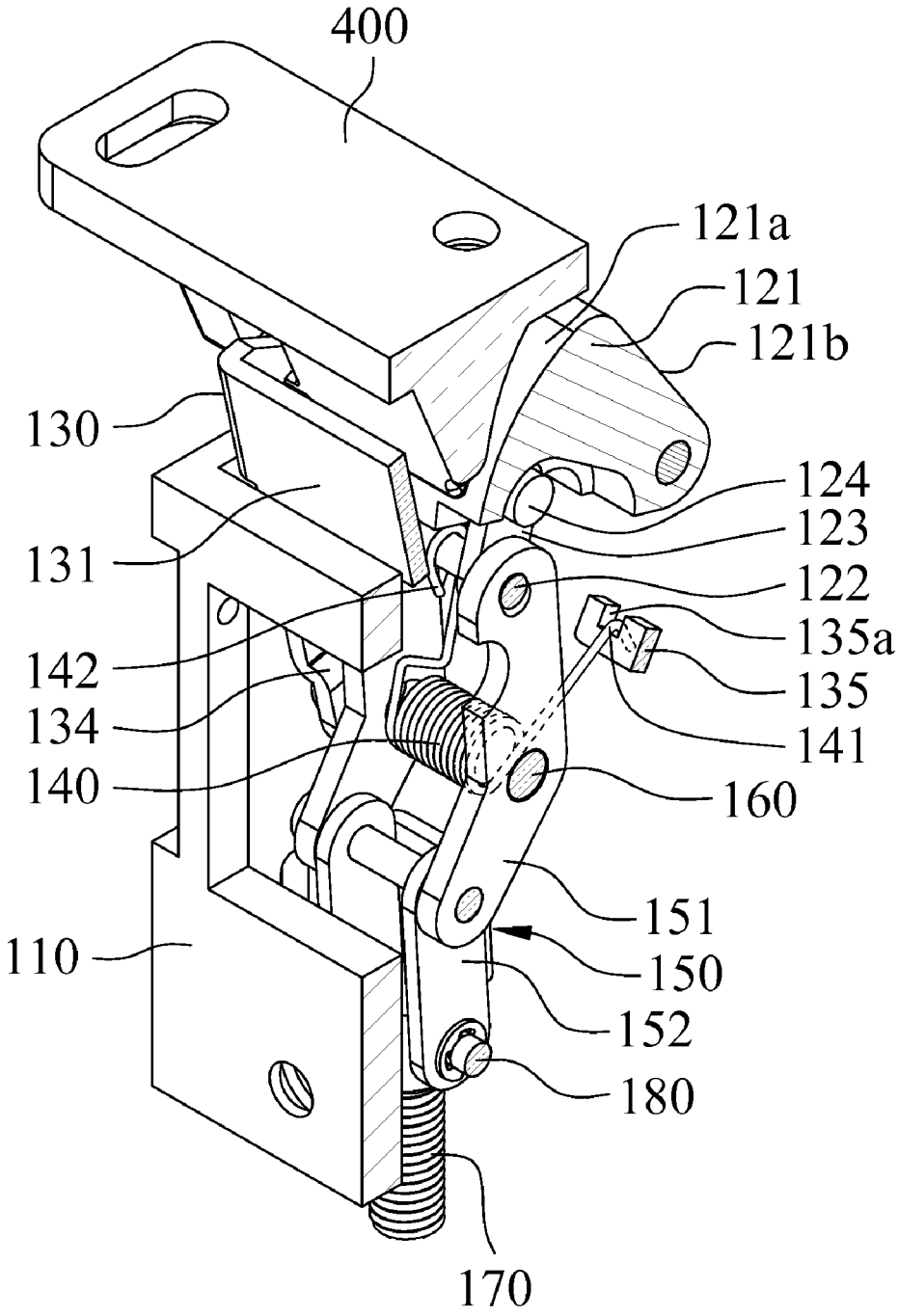
FIG. 8 is a perspective section view illustrating a lock state formed between the latch structure of fire door lock and the stopper in accordance with a preferred embodiment of the present invention.

Referring to FIG. 6, the latch structure of fire door lock 100 is disposed at a fire door 200, a lock state is formed between the latch structure of fire door lock 100 and a stopper 400 disposed at a door frame 300. With reference to FIGS. 4, 6, 7 and 8, wherein the latch bolt 121 of the latch unit 120 is protruded from the lock base 110, and the stopper 400 is located between the latch bolt 121 and the blocking member 130. The latch bolt 121 can be blocked by the stopper 400 to prevent the fire door 200 from being opened. The combining pin 122 is pivotally connected with the first linking members 151 and the actuating members 123 and configured to move along a path R. The first end portion 122*a* of the combining pin 122 can be restrained within the first recess 112*b*, and the second end portion 122*b* can be restrained within the second recess 113*b*. When the latch bolt 121 is pressed by external force, a thrust force is generated and tends to push the latch bolt 121 into the lock base 110. With reference to FIG. 6, the penetrating bolt 124 and the fixing rod 160 may define a line L which crosses the path R. The combining pin 122 slidably moves toward the bottom portion 111 of the lock base 110 along the path R, and stops moving until the combining pin 122 passes across the line L defined by the penetrating bolt 124 and the fixing rod 160, wherein the path R is viewed as the moving trace of the core of the combining pin 122, and the line L is a straight line which links the core of the penetrating bolt 124 and the core of the fixing rod 160. Besides, the combining pin 122 is configured to be spaced from the line L to the bottom portion 111 when the latch bolt 121 is located at the projected position. In this moment, the combining pin 122 can not move upwardly along the first sliding slot 112*a* and the second sliding slot 113*a*. However, the first end portion 122*a* of the combining pin 122 contacts against the first recess 112*b*, and the second end portion 122*b* contacts against the second recess 113*b* to enable the combining pin 122 to stop moving toward the bottom portion 111 of the lock base 110 along with the first and the second sliding slot 112*a*, 113*a* in counterclockwise direction. Accordingly, the latch bolt 121 may not be pushed into the lock base 110 via the actuation of the combining pin 122. The combining pin 122 and the actuating members 123 supports the latch bolt 121 to prevent the latch bolt 121 from being pushed into the lock base 110 by external force to lead an unlock situation.

Otherwise, the first end portion 122*a* of the combining pin 122 may contact against the first restraining recess 133*a* of the first lateral plate 133, and the second end portion 122*b* may contact against the second restraining recess 134*a* of the second lateral plate 134. Therefore, the combining pin 122 can not be actuated by the latch bolt 121 and can not separate from the first restraining recess 133*a* and the second restraining recess 134*a*. Mentioned design may prevent the latch bolt 121 from being pushed into the lock base 110 by external force to lead an unlock situation.

Figure 9:
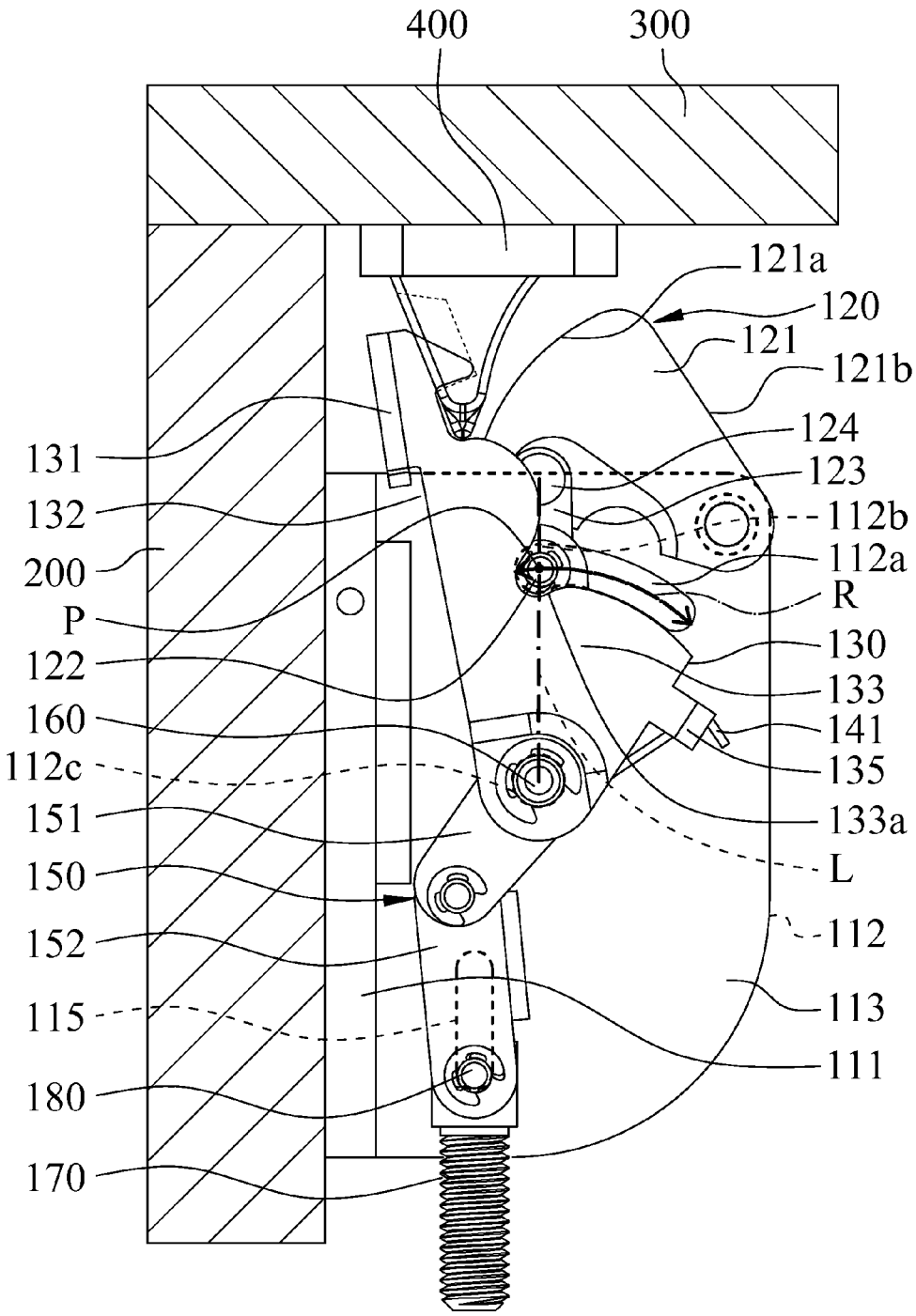
FIG. 9 is a schematic diagram illustrating a lock state formed between the latch structure of fire door lock and the stopper in accordance with another preferred embodiment of the present invention.

In another embodiment with reference to FIG. 9, when the latch bolt 121 moves to the projected position, the combining pin 122 moves toward the bottom portion 111 of the lock base 110 along the first sliding slot 112*a* and the second sliding slot 113*a*, and the combining pin 122 is configured to be at a crossing point P where the line L meets the path R when the latch bolt 121 is reached and located at the projected position. When the latch bolt 121 is at the projected position and pressed by external force, the combining pin 122 can not slidably move toward or backward along with the first slot 112*a* and the second slot 113*a* because the external force only acts in the direction to the fixing pin 160 (i.e. the line L) without acting in others directions. Accordingly, the combining pin 122 only tends to move toward the fixing pin 160 along the line L, however, the combining pin 122 remains stable because the walls of the first slot 112*a* and the second slot 113*a* block the combining pin 122 to move further along the line L. Therefore, the latch bolt 121 can not be pushed into the lock base 110 by linkage of the combining pin 122 to avoid an unlock situation.

Figure 10:
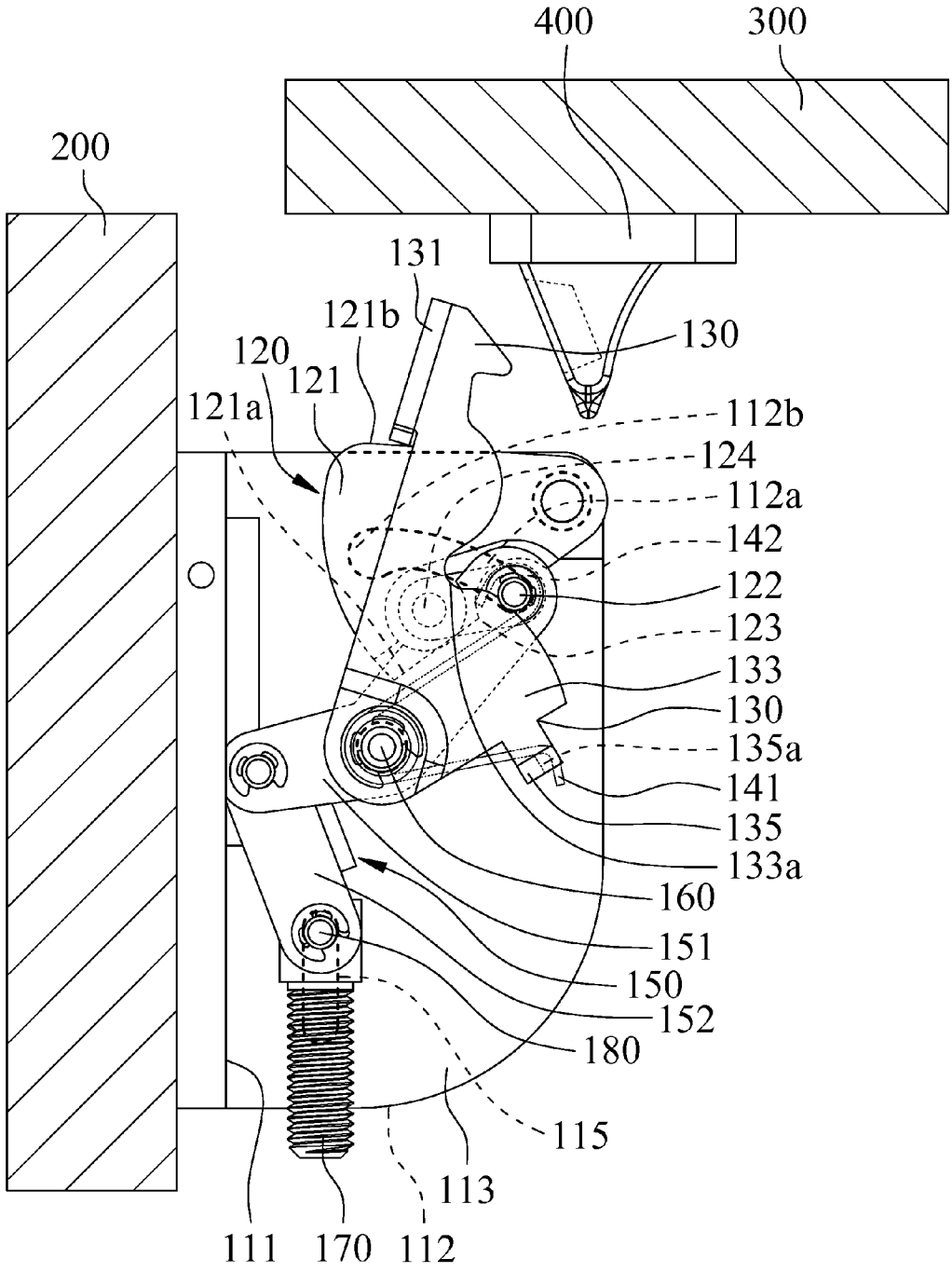
FIG. 10 is a schematic diagram illustrating an unlock state formed between the latch structure of fire door lock and the stopper in accordance with a preferred embodiment of the present invention.
Figure 11:
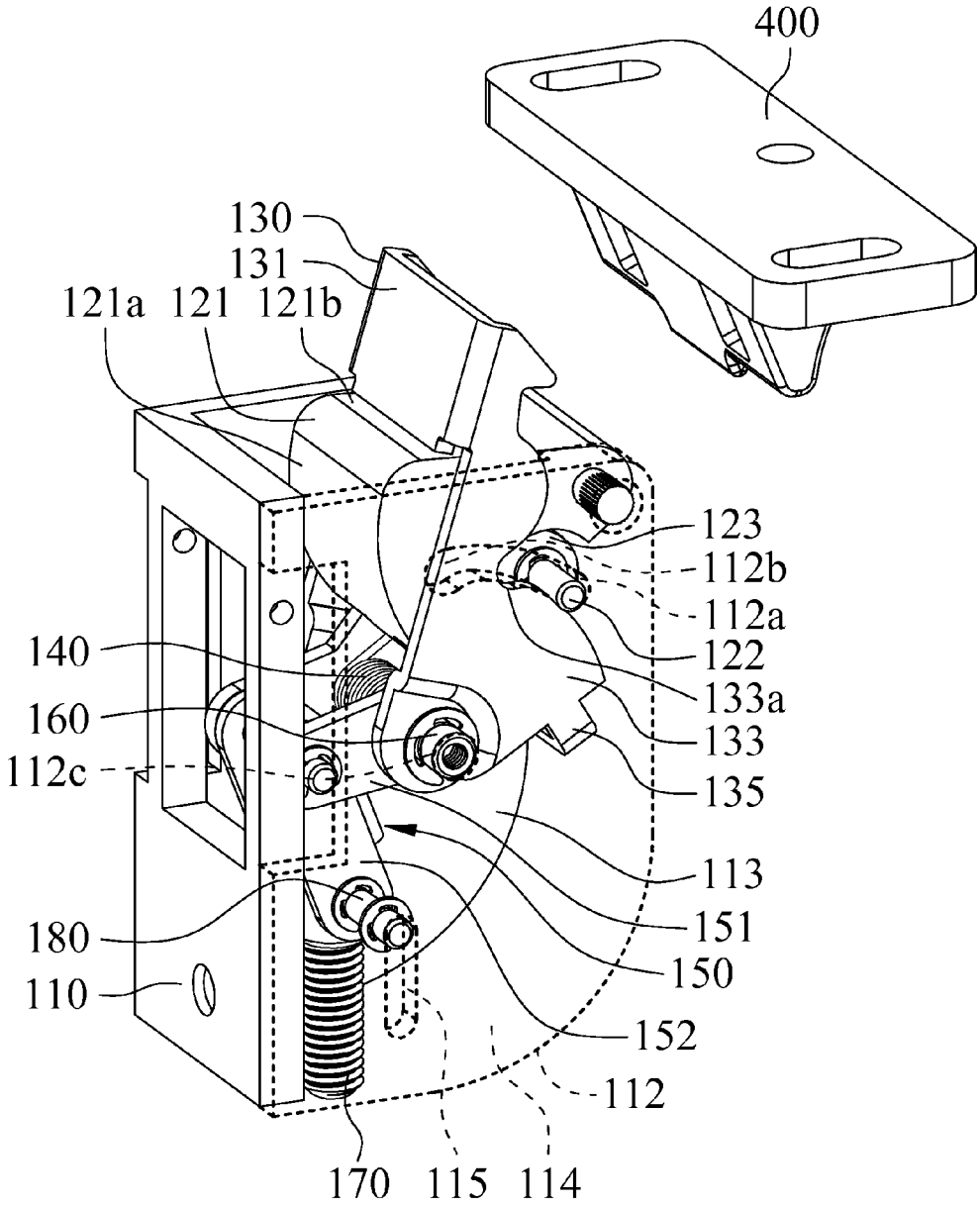
FIG. 11 is a perspective schematic diagram illustrating an unlock state formed between the latch structure of fire door lock and the stopper in accordance with a preferred embodiment of the present invention.
Figure 12:
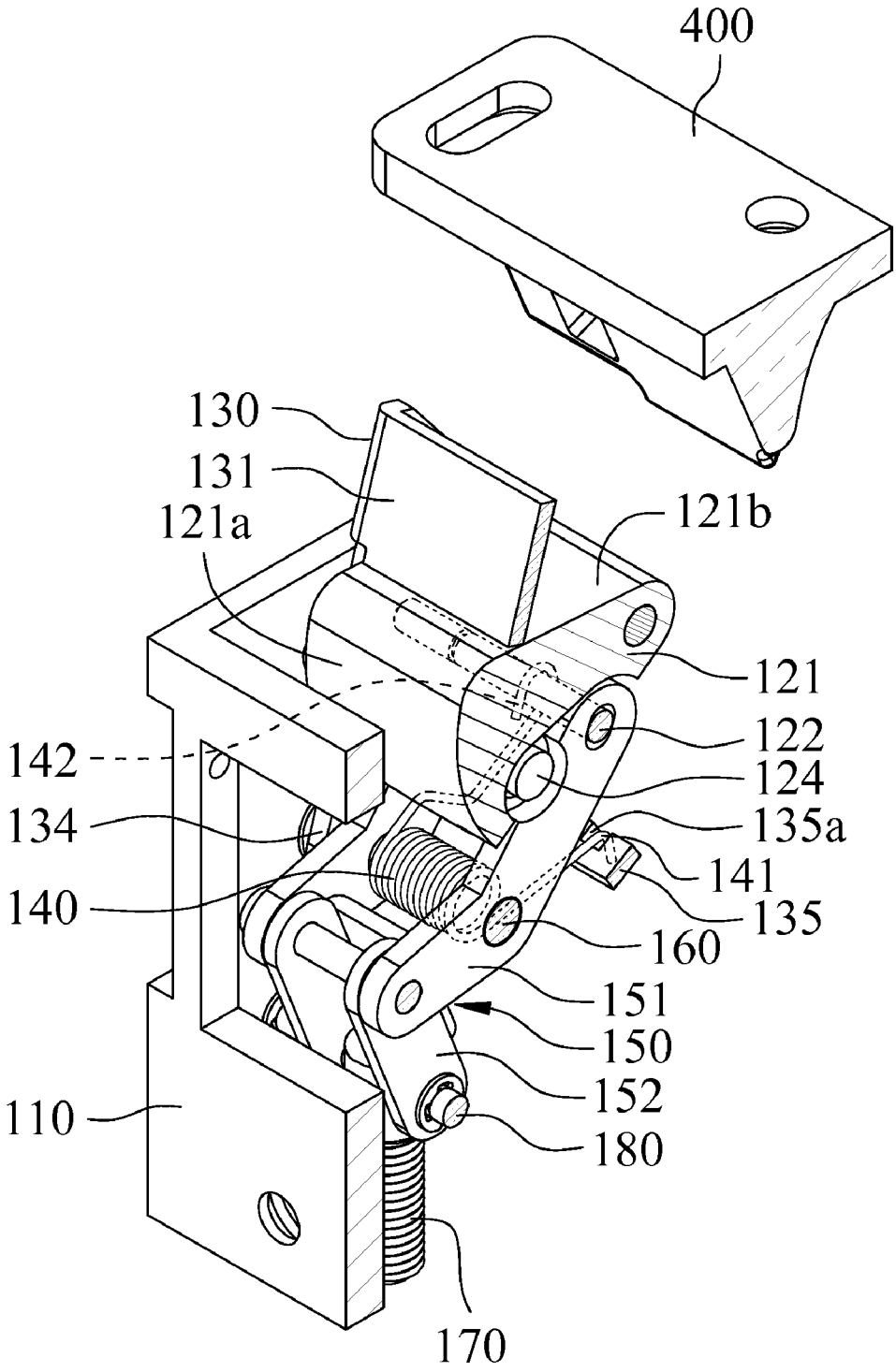
FIG. 12 is a perspective section view illustrating an unlock state formed between the latch structure of fire door lock and the stopper in accordance with a preferred embodiment of the present invention.

Referring to FIG. 10, FIG. 10 is a schematic diagram illustrating an unlock state formed between the latch structure of fire door lock 100 and the stopper 400. With reference to FIGS. 4, 10, 11 and 12, the pivoting rod 180 can be driven by the linking rod 170 to move upwardly along each of the longitudinal sliding slots 115, in the meantime, the second linking member 152 of the linking set 150 can be driven by the pivoting rod 180 to pivot toward the bottom portion 111 of the lock base 110. Besides, the first linking members 151 is pivotally connected with the second linking member 152 to enable the first linking members 151 to swing via the fixing rod 160 serving as a shaft. Due to the interconnection between the combining pin 122, the first linking members 151 of the linking set 150 and the actuating members 123 of the latch unit 120 and the movement limitation of the combining pin 122 within the first sliding slot 112*a* and the second sliding slot 113*a*, when the combining pin 122 is actuated by the first linking members 151, the combining pin 122 moves outwardly along with the first sliding slot 112*a* and the second sliding slot 113*a* to enable the first end portion 122*a* and the second end portion 122*b* to depart from the first recess 112*b* and the second recess 113*b* respectively. In the mean time, the actuating members 123 can be actuated by the combining pin 122, and the latch bolt 121 can be actuated by the actuating members 123 to enable the latch bolt 121 to shrink into the lock base 110. Meanwhile, the first end portion 122*a* and the second end portion 122*b* of the combining pin 122 are departed from the first recess 112*b* and the second recess 113*b* respectively to enable the blocking member 130 to stop being restrained by the combining pin 122. Furthermore, the blocking member 130 can be actuated by elasticity of the elastic member 140 to swing via the fixing rod 160 serving as a shaft. Also, the latch bolt 121 is accommodated into the restraining slot 132 of the blocking member 130, and the blocking plate 131 of the blocking member 130 contacts against the restraining surface 121*b* of the latch bolt 121 to prevent the latch bolt 121 from protruding to the lock base 110. Accordingly, when the state of the fire door 200 is switched from the unlock state to the lock state, the latch bolt 121 may pass through the stopper 400 rather than blocked by the stopper 400. The blocking member 130 may prop against the stopper 400 to enable the latch bolt 121 to depart from the restraining slot 132 of the blocking member 130, and then the latch bolt 121 can not be blocked by the blocking member 130. At last, the latch bolt 121 is protruded from the lock base 110 and enables the stopper 400 located between the latch bolt 121 and the stopper 130 to form a lock state.

In this invention, when the latch structure of fire door lock 100 is situated in the lock state, the first end portion 122*a* and the second end portion 122*b* of the combining pin 122 are restrained within the first recess 112*b* of the first sliding slot 112*a* and the second recess 113*b* of the second sliding slot 113*a* respectively. Therefore, the restraining function of the combining pin 122 is completely achieved. Or, the first end portion 122*a* and the second end portion 122*b* of the combining pin 122 can be restrained within the first restraining recess 133*a* of the first lateral plate 133 and the second restraining recess 134*a* of the second lateral plate 134 respectively. The first end portion 122*a* of the combining pin 122 contacts against the first recess 112*b* or the first restraining recess 133*a*, and the second end portion 122*b* contacts against the second recess 113*b* or the second restraining recess 134*a* to prevent the latch bolt 121 from being pushed into the lock base 110 by external force to lead an unlock situation. Therefore, the burglarproof function of the latch structure of fire door lock 100 can be significantly raised. Besides, when the fire door 200 is situated in the unlock state, the latch bolt 121 is shrunk into the lock base 110, and the blocking member 130 is swingable toward the latch bolt 121 via the fixing rod 160 serving as a shaft. The latch bolt 121 is accommodated into the restraining slot 132 of the blocking member 130, and the blocking plate 131 of the blocking member 130 contacts against the restraining surface 121*b* of the latch bolt 121. When the state of the fire door 200 is switched from the unlock state to the lock state, owing to the contact between the blocking plate 131 of the blocking member 130 and the restraining surface 121*b* of the latch bolt 121, the latch bolt 121 may pass through the stopper 400 easily. When the latch bolt 121 has passed through the stopper 400, the blocking member 130 may prop against the stopper 400 to enable the latch bolt 121 to protrude from the lock base 110 therefore forming the lock state. The burglarproof and fireproof functions of the latch structure of fire door lock 100 can be completely achieved.

While this invention has been particularly illustrated and described in detail with respect to the preferred embodiments thereof, it will be clearly understood by those skilled in the art that is not restrained to the specific features shown and described and various modifications and changes in form and details may be made without departing from the spirit and scope of this invention.

What is claimed is:

1. A latch structure of fire door lock comprising:

a lock base having a bottom portion, a first lateral portion, a second lateral portion and an accommodating slot defined by the bottom portion, the first lateral portion and the second lateral portion;

a linking set having at least one first linking member, the linking set is disposed at the accommodating slot of the lock base;

a fixing rod pivotally connected with the first linking member of the linking set, the fixing rod comprises a first fixing end and a second fixing end fixed at the first lateral portion and the second lateral portion respectively;

a latch unit having a latch bolt, at least one actuating member, a penetrating bolt and a combining pin, the penetrating bolt is pivotally connected with the latch bolt and the actuating member, the combining pin is pivotally connected with the actuating member and the first linking member and configured to move along a path, the latch bolt is swingably disposed at the accommodating slot of the lock base, and the latch bolt can be driven between a projected position and a retracted position in response to the movement of the actuating member; and when the latch bolt moves to the projected position, the penetrating bolt and the fixing rod may define a line which crosses the path, wherein the combining pin moves toward the bottom portion of the lock base along the path and stops moving until the combining pin crosses the line.

2. The latch structure of the fire door lock in accordance with claim 1, wherein the combining pin is configured to be located at a crossing point where the line meets the path when the latch bolt is located at the projected position.

3. The latch structure of the fire door lock in accordance with claim 1, wherein the combining pin is configured to be spaced from the line to the bottom portion when the latch bolt is located at the projected position.

4. The latch structure of fire door lock in accordance with claim 1, wherein the first lateral portion comprises a first sliding slot, the second lateral portion comprises a second sliding slot, the combining pin comprises a first end portion and a second end portion, the first end portion and the second end portion are slidably disposed at the first sliding slot and the second sliding slot respectively.

5. The latch structure of the fire door lock in accordance with claim 4, wherein the first sliding slot comprises a first recess, the second sliding slot comprises a second recess, the first recess and the second recess are adjacent to the bottom portion of the lock base, wherein the first end portion can be restrained within the first recess, and the second end portion can be restrained within the second recess.

6. The latch structure of fire door lock in accordance with claim 4, wherein the first lateral portion further comprises a first installing hole, the second lateral portion further comprises a second installing hole, the first fixing end and the second fixing end of the fixing rod can be inserted into the first installing hole and the second installing hole respectively, wherein the first sliding slot and the second sliding slot are formed into a concave arc, wherein each of the concave arcs is oriented to the first installing hole and the second installing hole separately.

7. The latch structure of fire door lock in accordance with claim 1, further comprises a blocking member swingably disposed at the accommodating slot of the lock base, the blocking member comprises a blocking plate and a restraining slot located beneath the blocking plate, and the restraining slot is corresponded to the latch bolt.

8. The latch structure of fire door lock in accordance with claim 7, wherein the blocking member further comprises at least one lateral plate protruded from the blocking plate, the lateral plate comprises a restraining recess, and the combining pin can be restrained within the restraining recess.

9. The latch structure of fire door lock in accordance with claim 7 further comprises an elastic member disposed at the accommodating slot of the lock base, the elastic member comprises a first end, the blocking member further comprises a contacting portion which is pressed by the first end of the elastic member.

10. The latch structure of fire door lock in accordance with claim 7, wherein the latch bolt comprises a restraining surface, the latch bolt can be restrained within the restraining slot of the blocking member, and the blocking plate contacts against the restraining surface.

11. The latch structure of fire door lock in accordance with claim 9, wherein the elastic member can be a torsion spring, the torsion spring further comprises a barrel portion disposed around the fixing rod.

12. The latch structure of fire door lock in accordance with claim 9, wherein the elastic member further comprises a second end, the second end is coupled to the combining pin of the latch unit.

13. The latch structure of fire door lock in accordance with claim 8, wherein the blocking member further comprises a contacting portion, the contacting portion can be a cantilever protruded from the lateral plate.

* * * * *